US005427371A

United States Patent [19]

Huston et al.

[11] Patent Number: 5,427,371

[45] Date of Patent: Jun. 27, 1995

[54] INDOOR GOLF HOLE AND INSTALLATION METHOD

[75] Inventors: Janet Huston, 106 E. Somonauk St., Yorkville, Ill. 60560; David R. Huston, Yorkville, Ill.

[73] Assignee: Janet Huston, Yorkville, Ill.

[21] Appl. No.: 253,399

[22] Filed: Jun. 3, 1994

[51] Int. Cl.[6] ..... A63B 57/00

[52] U.S. Cl. ..... 273/34 R

[58] Field of Search ..... 273/34 R, 34 A, 34 B, 273/178 R

[56] References Cited

U.S. PATENT DOCUMENTS

| | | | |
|---|---|---|---|
| 1,041,081 | 10/1912 | Hinckley | 273/34 R |
| 3,834,577 | 9/1974 | Tempero | 220/42 B |
| 4,748,787 | 6/1988 | Harbeke | 52/741 |
| 5,035,097 | 7/1991 | Cornwall | 52/220 |
| 5,120,063 | 6/1992 | Birchler et al. | 273/34 A |
| 5,131,657 | 7/1992 | Hughes | 273/177 R |

*Primary Examiner*—George J. Marlo

*Attorney, Agent, or Firm*—Lee, Mann, Smith, McWilliams Sweeney & Ohlson

[57] ABSTRACT

An indoor golf hole having a canister adjustably supporting a golf cup. The canister is engageable by use of a collar for supporting it to a subflooring in a room. A thread engagement between the collar and canister can provide means for vertically adjusting the height of the canister to accommodate different carpeting thicknesses. Alternately, interior adjustment mechanism may be provided within the canister to independently adjust the golf cup elevation. In other forms of the invention, the canister may be provided to be inserted within a cored hole in a poured concrete floor and embedded in hydraulic cement. In the concrete floor installation modes, the golf cup is supported and adjustable by means of a movable disk thread-adjustably supported within the canister for adjusting the height of the golf cup relative thereto. The canister may have a thread-engageable double-walled construction, or alternatively a cap with a threaded boss for thread-engaging a machine-type screw carrying the disk. A cover plate is provided to cover over the golf cup when not in use to allow people to walk safely across the room.

33 Claims, 5 Drawing Sheets

INDOOR GOLF HOLE AND INSTALLATION METHOD

BACKGROUND OF THE INVENTION

The invention relates to providing a golf hole for indoor recreational activity. In greater particularity, the invention relates to providing a golf hole which may be recessed in the floor of an indoor structure, most typically a family room or basement recreation room. Even more specifically, the invention provides for implementing the use of a conventional standard golf cup to be located in the floor of a residence or the like in a recessed arrangement similar to the disposition of a golf cup in the green of an outdoor golf course.

The invention further relates to providing such an indoor golf hole for use in practicing putting skills on an interior floor surface. This invention is further directed toward providing an indoor golf hole that is adjustable relative to the flooring and floor covering configurations whereby to be adaptable to a wide variety of room styles.

Another object of the invention is to provide an adjustable indoor golf hole which may be utilized in both a conventional floor and subflooring for framed flooring and also for use in a poured concrete floor typically found in residential basements.

It is further the goal of the invention to ultimately provide for the disposition of a flag stick and flag which may be removed during use in putting practice and to provide a cover for providing a generally coplanar surface across the aperture of the golf hole so that the floor surface is returned to a generally planar situation allowing persons to walk over without tripping or stumbling.

Another object of the invention is to further provide for adjustability wherein the golf cup retained in the indoor golf structure is vertically adjustable so that different floor coverings or subfloor configurations may be modified, changed or replaced while still allowing for the golf hole to be usable in a changed circumstance.

BRIEF SUMMARY OF THE INVENTION

The invention may be summarized as providing an upwardly open ended canister for disposition within a hole in a floor. The canister is cooperative with means for adjustably supporting a golf cup, which may be of the standard type used in regular outdoor golf course greens.

In one form of the invention, the canister includes upper exterior threading adjacent the open upper end of the canister which is threadably cooperative with a threaded collar having an outward extending flange. The flange is an annular member having a plurality of holes. The holes are intended to receive screw fasteners passing therethrough to secure the collar to the flooring in fixed relation. By means of the exterior threading on the canister, the canister may be rotated to move it upward and downward whereby to arrange the upper rim of the golf cup to be coplanar with the walking surface of the floor structure, which would normally be the carpeting on which a putted golf ball would travel. The collar further has a depending annular skirt having interior threads for the threaded engagement with the canister exterior threading. A lock screw or cap screw may be provided transversely to the vertical long axis of the canister whereby to pass through the annular skirt and lock the collar to the canister in the chosen vertical position. Thus the canister and collar may be pre-engaged before securing the collar to the floor so that the upper golf cup rim will be at the proper elevation. Thence, the assembled collar and canister may be secured together by means of the cap screw and then inserted into a hole in the floor, which has been precut to accommodate the cup and canister. Next, fasteners are inserted through the upper flooring surface and subflooring to threadably engage the multiple apertures in the flange of the collar whereby to secure the collar to the underside of the subflooring. Thereafter, the golf cup, which is usually a hard durable plastic, may be dropped into the canister whereby the upper rim may be coplanar with the upper side of the carpet. The canister further having a lower open end and an inwardly directed annular shoulder therearound for supporting the golf cup.

The golf cup may have the usual flag stick-receiving bore at the bottom joined by inclined lower separated webs supporting the bore structure whereby a golf ball would fall to the bottom of the cup and reside on the webs when putted into the hole. A golf flag stick, or miniature version thereof, may be supported within the bore to provide a simulated green-like appearance for the golf hole in a family or recreation room of a dwelling, or other interior room of an office, club, clubhouse, etc.

In another form of the invention, the canister includes a flared upper portion wider than the remaining lower diameter of the cylinder for use in securing the canister to a concrete floor. In this embodiment, the application is envisioned for a basement recreation room of a home having a usual poured concrete floor. A concrete saw, drill, or the like is used to core out a hole for the canister. Hydraulic cement may then be poured into the hole. Thence, the canister is dropped into the hole and the upper flared portion is inherently forced to slightly collapse inwardly from the outside without effecting the inside diameter of the canister and thereby secures the canister in the concrete floor. A different type adjustment means is provided within the canister to adjustably support a golf cup in order for the golf cup to be adjusted to the intended elevation. This is desired because typically the poured concrete floor would only be about four inches thick and a golf cup will usually be greater than that depth. The adjustment includes a double-walled arrangement at the bottom of the canister having an upper wall with a central aperture therethrough. A circular disk having a central aperture screw-engageable with a machine screw, or the like, may be deposited within the canister so that by turning the machine screw the elevation of the disk may be adjusted by threading it in one direction or the other within the aperture of the upper double-wall of the canister. Thereby, the bottom elevation of the disk may be changed to support the golf cup thereon in adjustable relation in order to provide for the upper circular rim of the golf cup to be coplanar with the upper circular rim of the canister and/or the putting surface of the flooring.

In the desirable form of the invention, the concrete floor is first cored to a larger diameter than the canister and expandable hydraulic cement is poured into the cored hole. Then the canister may be dropped in. This is particularly desirable when the canister is to go deeper through the concrete floor then its thickness. Additional screw fasteners or nails may be forcibly projected into the concrete from the inside of the upper flared portion of the canister to secure the canister to the floor.

In a third form of the invention, the adjustment means for the golf cup is provided by a vertically adjustable support disk adjustably positioned near the bottom of the canister. The disk includes a central aperture having a machine screw extending therethrough and secured thereat, preferably by a jam nut. The machine screw is thread-engaged to the boss of a cap or the like arranged below an open bottom end of the canister. The cap includes a central boss for receiving the machine screw whereby the disk may be adjusted vertically by the upward or downward threading of the machine screw into the boss. The golf cup is supported within the canister on the disk to thereby be in an adjustable relationship. In this form of the invention, the golf hole may be constructed within a cored out hole cutout of a poured concrete floor without the need for using a flared upper strip at the top of the canister. In this third embodiment, hydraulic cement may be utilized to surround the canister and extend below the typical four inch thick concrete floor usually encountered in residential construction.

In a fourth embodiment of the invention, an identical adjustment means is provided as in the third embodiment but may be used for positioning the golf cup in a framed floor. In this embodiment, a flanged collar may be formed integrally with, and adjacent the open upper end of, the canister, or thread engaged to exterior threading around the canister, or otherwise fixed, such as by adhesive, around the canister upper open end. The flanged collar may similarly provide spaced apart apertures around its annular flange extending whereby to be engageable underneath the subflooring, as in the first-mentioned embodiment. In the fourth embodiment, however, the adjustment of the golf cup is not made by action of the collar, but rather by the adjustment of the disk located near the bottom of the canister.

The golf cup may be the same in all embodiments and preferably duplicates the standard outdoor golf hole cup used on a putting green on a golf course.

In all embodiments of the invention it is envisioned that a heavy decorative metal plate having a flat top surface be provided, which serves to cover the hole when not in use in order that persons may walk across a room without tripping or stumbling on the hole. The plate would have a downwardly extruding plug with a diameter just slightly smaller than the golf cup for insertion therein. A heavy metal, such as brass, could be used whereby no additional fasteners would be required for the plate to be surely positioned over the golf cup when not in use.

DETAILED DISCUSSION OF THE PREFERRED EMBODIMENT

Figure 6:
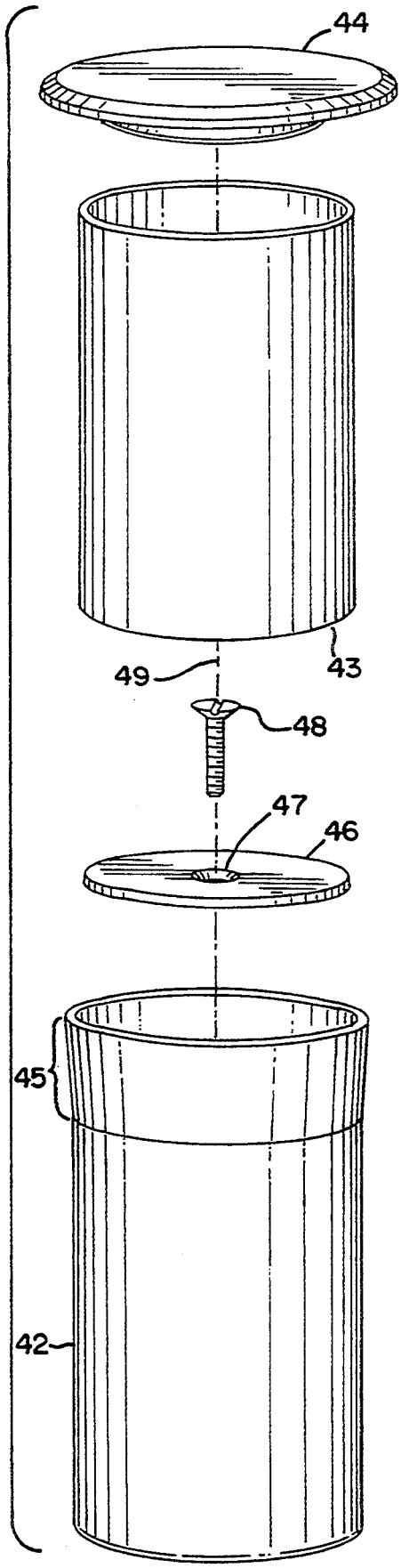
FIG. 6 is similar to FIG. 3 and is an exploded view of the second form of the invention showing the cover plate, golf cup, machine screw for adjustment, central adjustable disk and canister.
Figure 7:
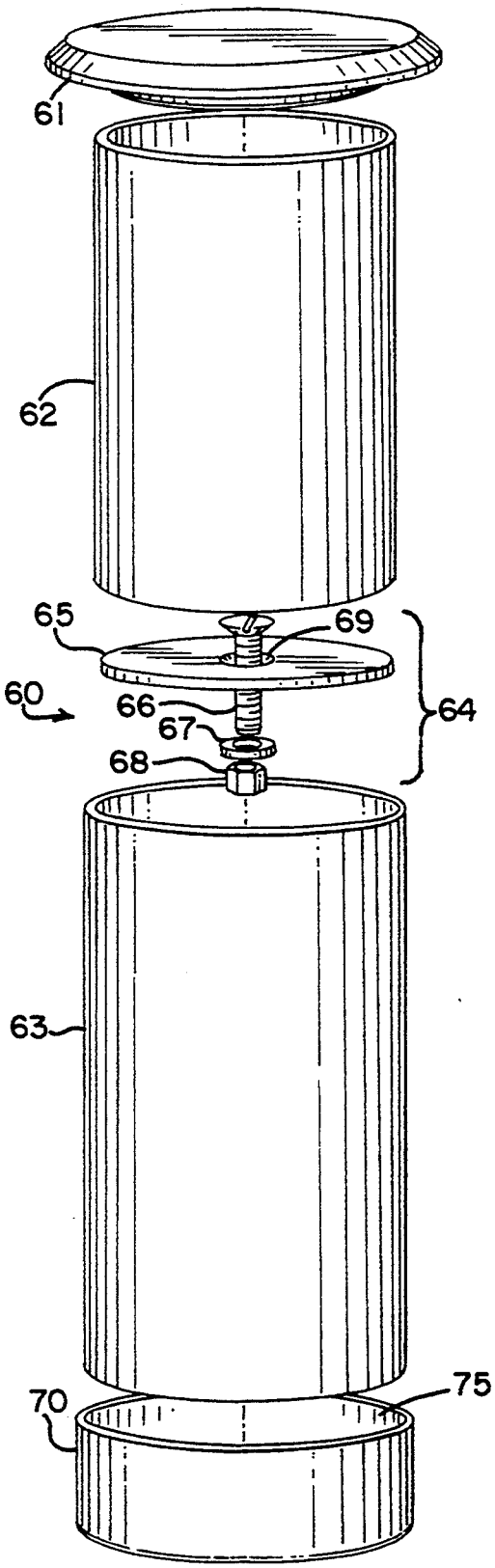
FIG. 7 is an exploded view of a third embodiment of the invention showing a cover plate, golf cup, adjustment disk and screw assembly, a canister, and a bottom cap for adjustably engaging the disk and screw assembly.
Figure 9:
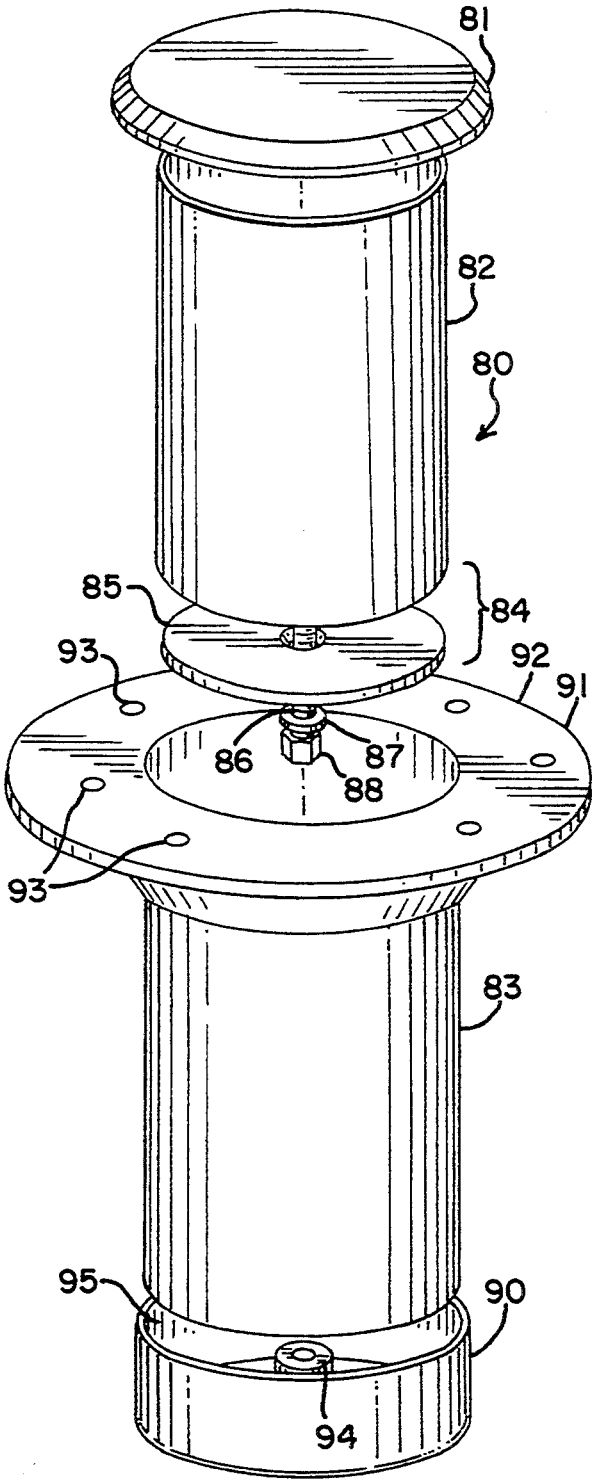
Figure 8:
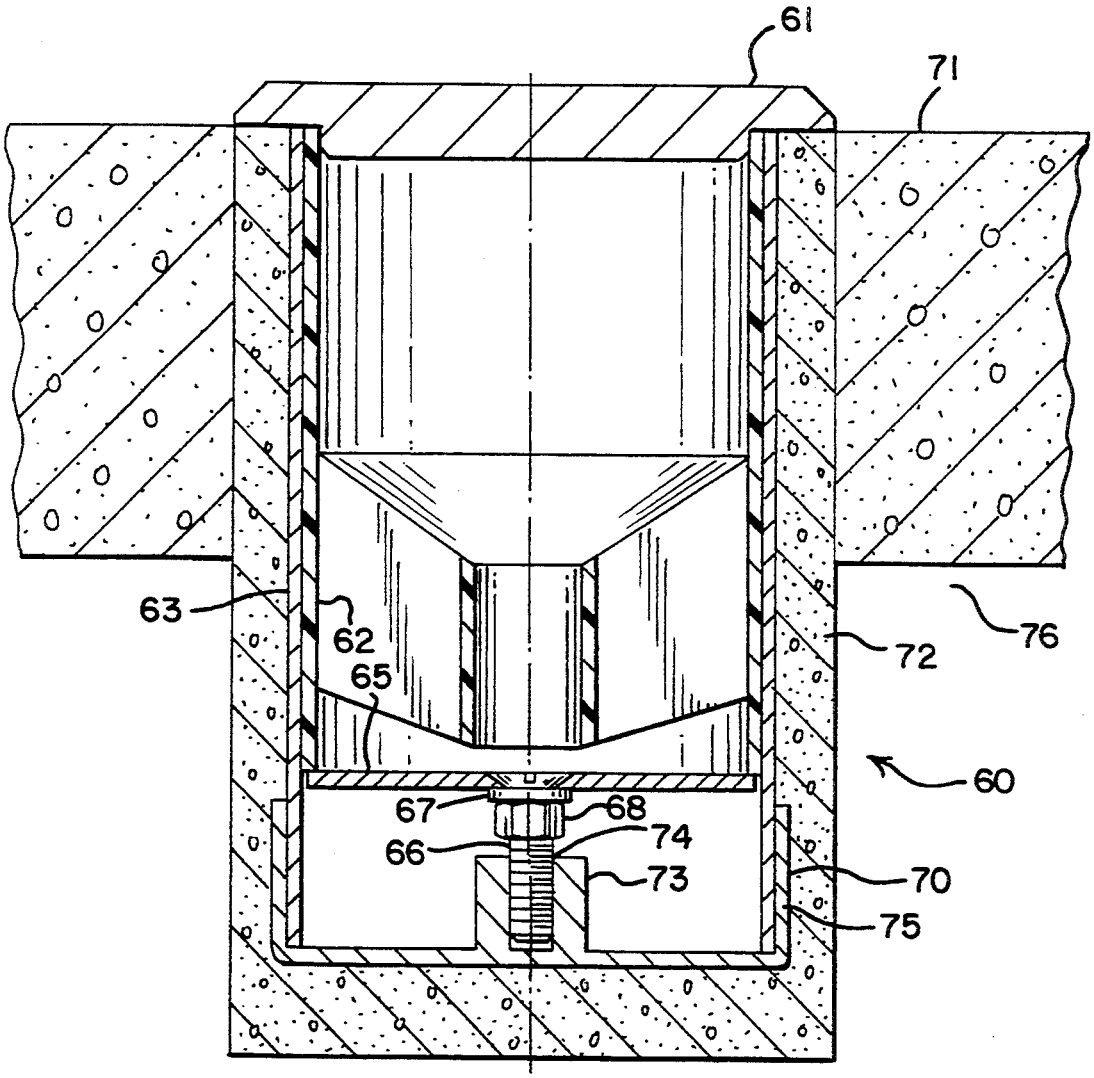
FIG. 8 is a vertical, central sectional view of the third embodiment shown in FIG. 7 showing the golf cup installed in concrete flooring; and, FIG. 9 shows a fourth embodiment of the invention substantially identical to that of FIGS. 7 and 8 but wherein the canister further includes a mounting collar whereby to make this embodiment engageable beneath the subflooring of a framed floor construction.

Turning now to the figures, wherein like reference numerals refer to the same elements throughout, it will be understood that two embodiments of the invention are provided. A first embodiment is depicted in FIGS. 1–4 for use in a typical wood-framed, or other similar, floor and subflooring construction. The second embodiment is illustrated in FIGS. 5 and 6 for installation of the invention in a poured concrete floor, such as would normally be found in the basement of a residential dwelling. Third and fourth embodiments for both types of floorings are shown in FIGS. 7–9 providing a cup adjustment means near the bottom of the canister.

Figure 1:
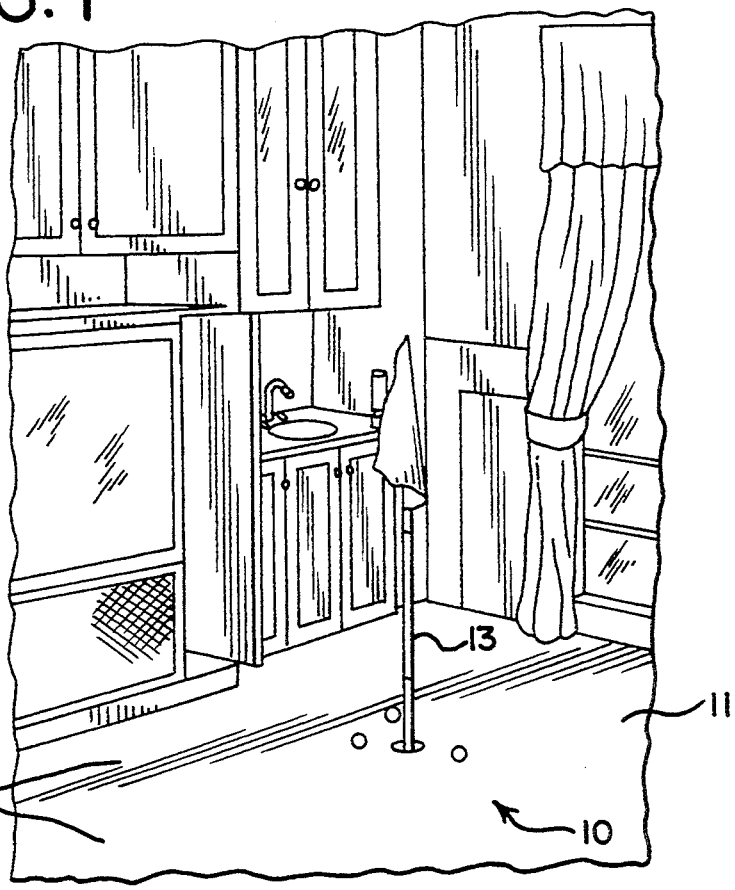
FIG. 1 is a view of the preferred form of the invention in a recreational room extending through carpeting, wood flooring and subflooring therebelow.

Looking first at FIG. 1, it will be seen that an indoor golf hole 10 is installed in the floor 11 of a recreation room 12 of a residential dwelling. The indoor golf hole 10 is further cooperative with a flag stick 13 which may be of the usual design found on a golf course, but having a vertical dimension as chosen by the golfer/homeowner to fit in the room.

Figure 2:
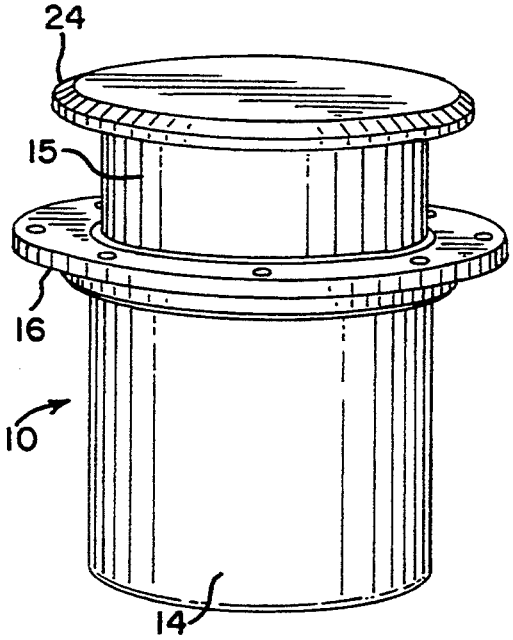
FIG. 2 is an elevational view of the canister, adjustable collar and cover plate.
Figure 3:
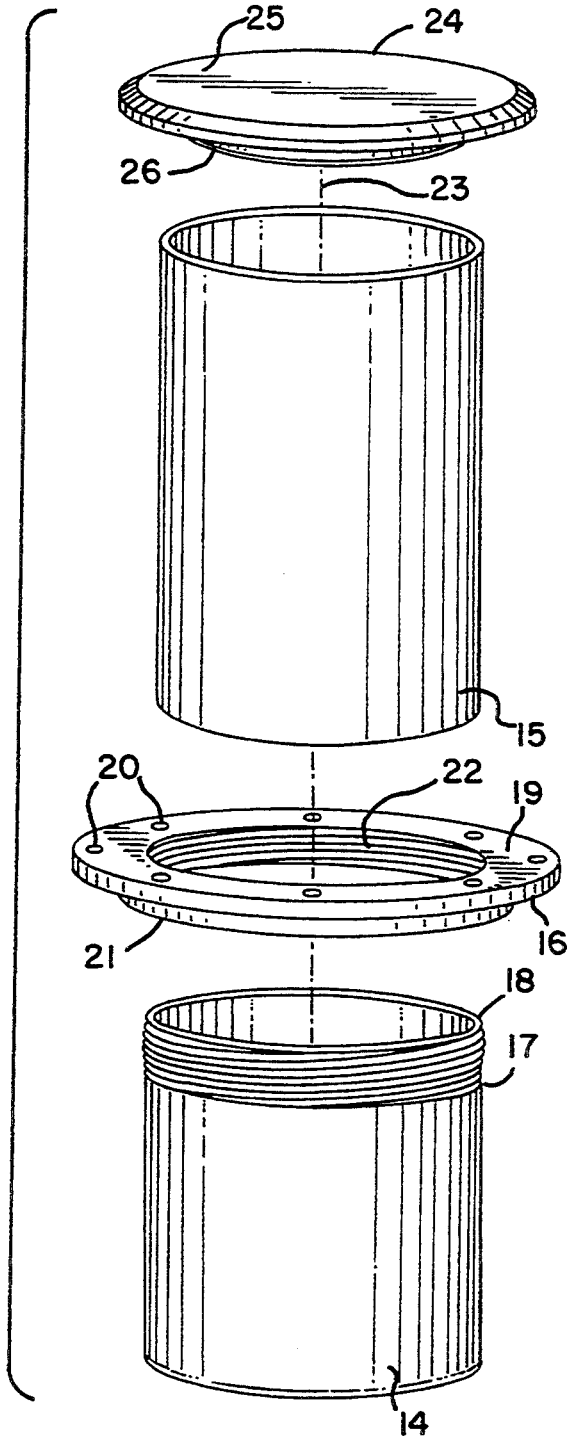
FIG. 3 is an exploded view of the apparatus in FIG. 2 showing the cover plate, golf cup, collar and canister in an exploded vertical arrangement.

The invention will be more fully appreciated in reference to FIGS. 2 and 3. Therein it will be observed that the indoor golf hole 10 comprises an upwardly open canister 14 for supporting a typical golf cup 15 therein. The golf cup 15 extends outwardly and above the canister 14 for the purpose of extending to be coplanar with an upper floor covering surface, as will be explained hereinafter. The canister 14 is threadably cooperative with a threaded collar 16. The canister 14 has exterior threads 17 cut therein and extending therearound adjacent an upper rim 18 around the upper open end thereof. The collar 16 comprises an annular flange 19 having a plurality of holes 20 therethrough. The collar 16 further includes an annular depending skirt 21 having threads cut interiorly thereon for threadable engagement with the threads 17. Thereby, the collar 16 and canister 14 may be threadably adjusted to dispose them in various relative positions along a central longitudinal axis 23 of the indoor golf hole 10 as shown in FIG. 3. As will be discussed in regard to FIG. 4, the purpose of the relative threadable attachment of the collar 16 and canister 14 is for the purposes of accommodating different floor constructions so that vertical adjustment can be made to place the cup 15 at the intended height.

In the preferred embodiment, when the indoor golf hole 10 is not in use, a heavy cover plate 24 is provided to cover the indoor golf hole 10 to prevent people from tripping or stumbling on the opening to the golf cup. The cover plate 24 includes an upper plate 25 with a depending insert plug-like member 26 which is circular and has a diameter sized to snugly fit within the golf cup 15 whereby the cover plate 24 may be placed atop the indoor golf hole 10 to offer a smooth walking surface that may be easily removed by lifting off the cover plate 24. The assembled view in FIG. 2 shows the threadable engagement of the collar 16 to the canister 14 wherein the cup 15 is supportably held within the canister 14 and the cover plate is plugged thereon.

Figure 4:
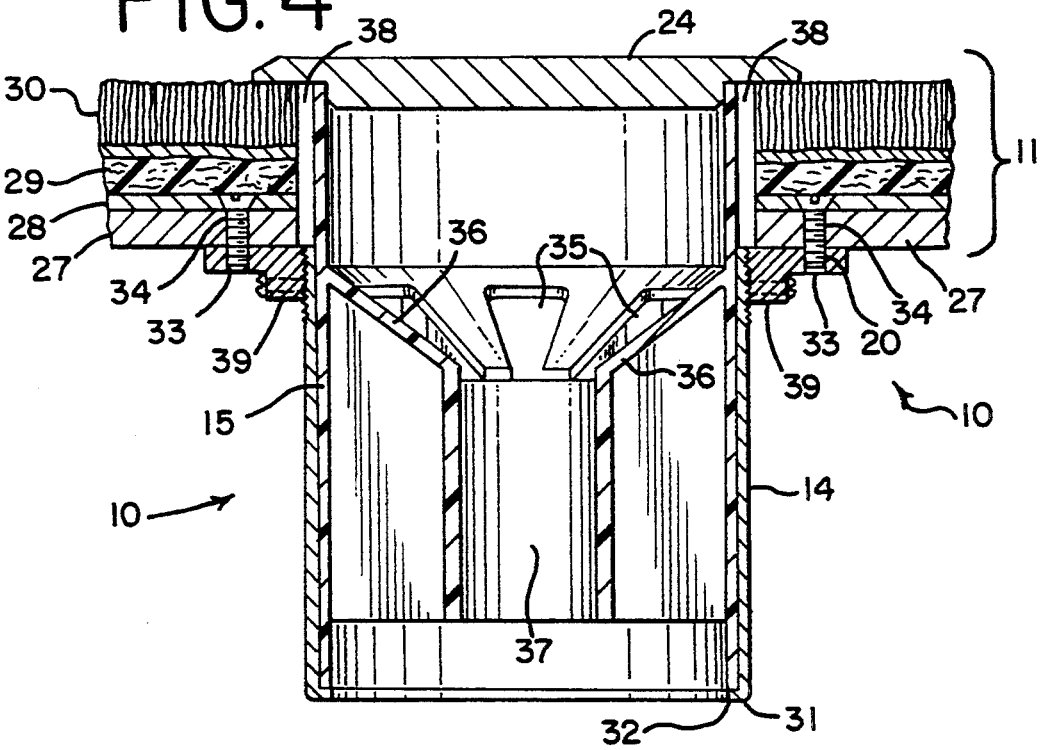
FIG. 4 is a vertical, central sectional view of the installed golf hole as in FIG. 1 showing the golf hole installed in a floor structure having indoor carpeting, carpet padding, flooring and subflooring.
Figure 5:
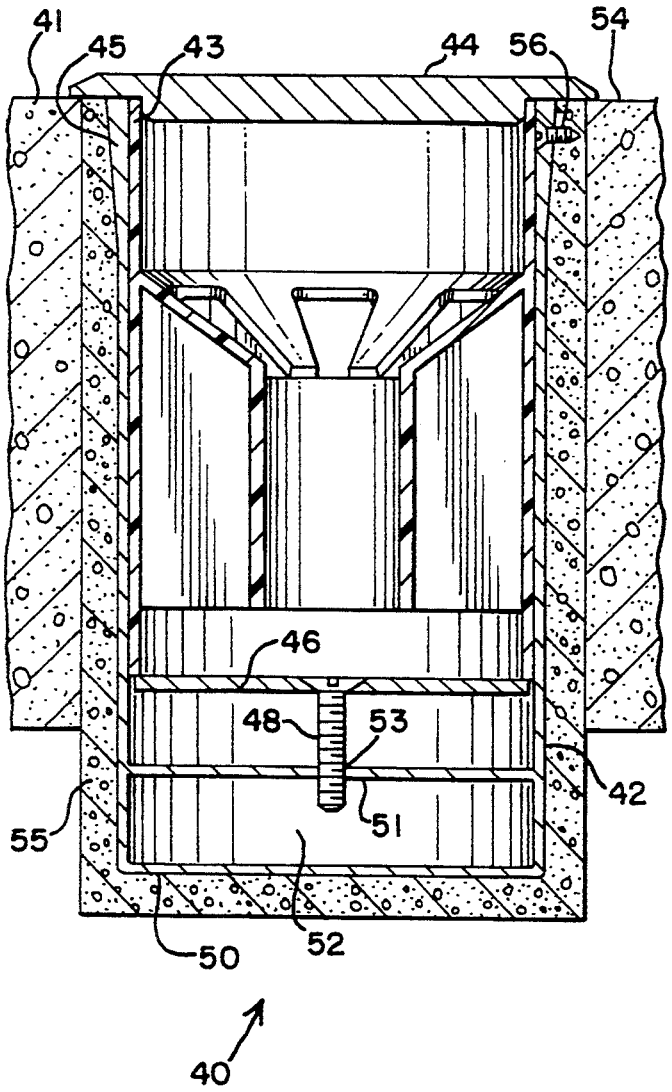
FIG. 5 is a similar cross-sectional view of a second form of the invention for use in concrete flooring and is also a central vertical sectional view thereof.

FIG. 4 shows the indoor golf hole 10 in greater detail by providing a vertical sectional view passing generally through the central longitudinal axis 23 and further depicting the installation of the indoor golf hole 10 relative to the flooring construction 11 as noted in regard to FIG. 1.

The flooring construction 11 of the preferred embodiment comprises a thick plywood subflooring found in typical residential construction. Thereon is laid a wood flooring surface 28, which may be another plywood layer, high quality wood planking, or other suitable wood or flooring surface layer, including tile parquet-shaped materials, resin, etc. In the preferred embodiment, the surface 28 has a carpet padding 29 placed thereover and a wall-to-wall carpet 30 installed over the padding in a usual way. Thus, the section shown in FIG. 4 is at a location between floor joists so that there is no impedance to the canister 14 extending below the subflooring 27. Of course the locations of the floor joists need to be determined before beginning the installation of the indoor golf hole 10.

The canister 14 will be observed to further include a lower rim 31 having a small inwardly directed annular shoulder 32 for purposes of supporting the bottom of the golf cup 15 therein.

The canister 14 is supported by the collar 16 which is attached to the subflooring 27 by means of machine screws 33 that extend through the flooring 28 and subflooring 27 for thread engagement with the plurality of holes 20. When the correct location for the indoor golf hole is determined by the installer, holes 34 may be drilled through the flooring 28 and subflooring 27 in positional correspondence with the holes 20 as would be clear to a carpenter, for example.

Once the collar 16 is secured underneath the subflooring 27 as shown in FIG. 4, the canister 14 may then be rotated to threadably arise or descend relative to the floor construction 11 whereby to position the cup 15 at the desired height relative to the upper surface of carpeting 30, possibly in coplanar relationship with the carpeting, so that the golfer may smoothly putt a golf ball into the cup in similar fashion to putting on an outdoor golf course green. The relative adjustability of the collar 16 and canister 14 therefore allows for the cup 15 to be moved upwardly and downwardly for different floor construction depths. This also allows for the homeowner to change carpeting and yet have the golf hole usable with various thicknesses of carpeting that may be installed. In FIG. 4 the cover plate 24 is arranged on the cup 15 to cover it.

The interior of the golf cup 15 is shown in section and has the usual cutouts shown generally at 35 with webs 36 therebetween and an integrally formed supporting bore 37 for receiving a flag stick. These interior features of the golf cup are depicted for purposes of illustration, showing the usability of a standard outdoor golf cup, but form no part of the invention itself.

Also in regard to FIG. 4, it will be understood that an aperture is cut through the floor construction 11. An annular spacing 38 is illustrated in an exaggerated dimension to show the cut portions of the carpet, padding, flooring and subflooring as being spaced away from the exterior of the cup 15. This spacing could be reduced whereby the cup would be in close proximity to the carpet padding, flooring and subflooring. The upper rim 18 need not be coplanar with the flange 19 as shown, but may be above or below depending on the position needed for the cup 15.

When the correct relative relationship of the canister 14 is achieved to place the golf cup 15 at the proper elevation, the canister may be locked to the collar 16 by the provision of set screws 39 extending radially through the skirt 21. Upon tightening the set screws 39, they radially travel to abut the threads 17 of the canister 14 to lock the canister 14 in place.

With reference now made to FIGS. 5 and 6, a second embodiment of the invention is provided in the form of indoor golf hole 40 shown in a cross sectional assembled view in FIG. 5 and in an exploded view in FIG. 6. Indoor golf hole 40 is provided for installation in a poured concrete floor 41, such as might be found in a typical residential basement family room, lower level recreation room, or the like. In the disclosed embodiment, the indoor golf hole 40 comprises a canister 42 for supporting a golf cup 43 that is the same as golf cup 15. A cover plate 44 is provided for covering over the golf cup 43 when not in use and in the exemplary embodiment is the same construction as cover plate 24.

The canister 42 has a constant interior diameter but includes an outwardly flared circumferential strip 45, the purpose of which will be described below. The canister 42 is further defined by its cooperative engagement to an adjustable disk 46 having a central aperture 47 for receipt therethrough of a machine screw 48. The aperture 47 is made along the central long axis 49 of the indoor golf hole 40 as shown in FIG. 6.

The canister 42 is further defined by the provision of a double-walled bottom as shown in FIG. 5. The canister 42 includes a closed bottom wall 50 and a second, or double, wall 51 being integrally formed with the canister 42 and spaced above bottom wall 50 to define a space 52 therebetween. The second wall 51 includes a central aperture 53 threadably engageable with the machine screw 48. The machine screw 48 may be fully threaded engaged through aperture 47 of disk 46 and then thread engaged with the aperture 53. Thereby, the vertical elevation of the disk 46 may be adjusted relative to the second wall 51 by advancing or retreating the position of the machine screw 48 therein. It will be clear that the disk 46 provides the supporting surface for the golf cup 43 whereby to vertically move it in order to conform and match the upper surface of the concrete floor 41 generally denoted at reference numeral 54. The disk 46 has a diameter sized to fit within the canister 42 and preferably being just slightly smaller than the diameter of canister 42.

The installation of the indoor golf hole 40 is first achieved by boring or cutting through the concrete floor in at least a sufficient diameter and depth to receive the canister 42. A hydraulic cement denoted at 55 may be injected into the coring and the canister 42 inserted therein. The flared strip 45 will tend to push outwardly on the portion of the hydraulic cement 55 surrounding it whereby to achieve a close snug fit. The hydraulic cement 55 may be required because it is often the case that the canister 42 is taller than the depth of a residential concrete floor. Standard residential concrete floors are usually only four inches deep. The cement 55 will harden and embed the canister 42. The flared strip 45 is forced inwardly by the cement but does not affect the inside diameter. Additional screws or nail fasteners, shown at fastener 56, can be forced through the canister into the cement 55 to further secure the canister 42 to the floor 41.

Upon the installation of the canister 42 the disk 46 can be vertically adjusted by means of turning the machine screw 48 to offer a moveable support for the cup 43 in order that it can be levelled with the upper floor surface 54 and provide a smooth putting surface. Of course, if carpeting, tile, linoleum, or other floor covering is placed atop the surface 54, the machine screw 48 may be re-adjusted to dispose the disk 46 at a greater elevation so the top of the cup 43 would, if desired, meet the floor covering surface, similar to the way the indoor golf hole 10 can meet the carpet 30, as shown in FIG. 4.

Turning now to FIG. 7, a third embodiment of the invention is shown in an exploded view. In this embodiment, an indoor golf hole 60 is shown with a cover plate 61 as in the first and second embodiments. The cover plate 61 is provided to fit and plug within a golf cup 62 which may be the same construction as in the first two embodiments and emulate a standard golf cup, or in fact comprise an actual golf cup used for outdoor golf facilities.

The indoor golf hole 60 further includes an upwardly and downwardly open ended canister 63 for receipt of the golf cup 62 therein. The canister 63 cooperates with a disk and screw assembly 64 comprising a circular disk 65, machine screw 66, washer 67 and jam nut 68 for locking the screw 66 within an aperture 69 formed in the center of the disk 65. The bottom of the canister is covered by a cap 70 which is mountably cooperative with the disk and screw assembly 64, as will be further understood in regard to FIG. 8.

In FIG. 8, the indoor golf hole 60 is shown installed in a poured concrete floor 71 wherein the floor has been bored to receive the indoor golf hole 60 and at a larger diameter than the canister 63. The void is filled, as in the description of FIG. 5, with a hydraulic cement 72. In this embodiment, a flared upper strip of the canister is eliminated. It will be further seen that the cap 70 includes a central boss 73 with a threaded bore 74 for thread engagement with the machine screw 66. With the machine screw locked by the jam nut 68 onto the disk 65 through the aperture 69, the use of a screw driver will facilitate rotating the machine screw 66 within the bore 74 to thereby change the relative position of the disk 65 within the canister 63. The disk 65 is slightly smaller in diameter than that of the canister 63 as would be understood. The golf cup 62 is supported on the disk 65 and its elevation may be raised or lowered by means of the machine screw 66. In the preferred embodiment, the cap 70 includes a side wall 75 that closingly fits around the bottom of the canister 63. In an alternate form of this embodiment, the side wall 75 may be eliminated and the cap 70 would be simply shaped as a flat steel plate with a threaded boss 73 centrally located thereon. This alternate embodiment would be preferred if the canister 63 were made of steel. In the preferred form of all of the embodiments of the invention, it is envisioned that the canisters thereof may be made of a hard durable plastic, but may be optionally made of metal, including aluminum brass alloys, etc. In the third embodiment of FIGS. 7 and 8, the concrete floor 71 is drilled or cut-out and will normally extend below the concrete into the usual sand and gravel 76 therebelow, because the golf hole 60 requires a greater depth than the standard four inch poured concrete floor 71. The cap 70 and canister 63 may then be placed into the void and hydraulic cement 72 poured therearound to embed them. The machine screw 66 is then engaged within the boss 73 to dispose a disk 65 at a height whereby the golf cup 62 may be at an intended elevation relative to the concrete floor 71. In the disclosed embodiment, the machine screw 66 is a $\frac{3}{8}$ inch diameter screw, $1\frac{1}{2}$ inches long, and the jam nut 68 is $\frac{3}{8}$ inches I.D. Of course, a longer machine screw may be used for thicker flooring environments.

It will be appreciated that the disk and machine screw assembly 64 adjustment shown for the embodiment comprising indoor golf hole 60 is generally related to the machine screw adjustment as shown at 48 in the indoor golf hole 40. However, the double-walled construction of golf hole 40 is modified to the cap 70 and boss 73 structure of golf hole 60, thereby allowing for the disk 65 to be threadably adjusted by means of the machine screw 66 cooperative with the threaded bore 73.

With attention now directed toward FIG. 9, an indoor golf hole 80 is provided in a fourth embodiment of the invention. The indoor golf hole 80 is identical to the indoor golf hole 60, but adds a means for attachment to a framed subflooring instead of a poured concrete floor. Specifically, the indoor golf hole 80 comprises a cover plate 81, golf cup 82, canister 83, disk and screw assembly 84 (85–89) and cap 90, respectively, duplicating elements 61–70 of indoor golf hole 60, as would be understood. However, there is added the provision of a collar 91 having an outwardly extending annular flange 92 with a plurality of apertures 93, similar to the configuration of the collar 16 of indoor golf hole 10. It will be understood that in the embodiments of FIG. 7 and 9, the indoor golf holes 60 and 80 provide for a snug attachment between the caps 70, 90 and canisters 62, 83 respectively. If plastic is chosen, the attachment can be adhesive, friction fit, mechanical fasteners, or threading. If desired, the caps (70,90) and canisters (62,83) may be integrally formed, although possibly more difficult to manufacture. The attachment of the caps to the canisters is more important in regard to the indoor golf hole 80, wherein the canister would depend downwardly from the collar 91, than in the embodiment of indoor golf hole 60, as shown in FIG. 8, where both the canister and the cap are embedded together in the hydraulic cement 72.

In the indoor golf hole 80, the vertical adjustment of the golf cup 82 is made by the action of the disk and screw assembly 84. As in golf hole 40, the machine screw is accessible while the golf cup in place by inserting a screw driver through the flag stick bore, i.e., 37 in FIG. 5. The cap 90, as for cap 70 of indoor golf hole 60, includes a threaded bore bearing reference numeral 94 to receive the machine screw 86 similar to the receipt of the machine screw 66 within threaded bore 73 for the embodiment of indoor golf hole 60. The cap 90 having circular side wall 95 for placement around the bottom open end of the canister 83 in a snug arrangement achieved by the above-described friction fit, threading, fastening or adhesive bonding. The cap 90, canister 83, and collar 91, may be made of a hard durable plastic, such as PVC. Of course, steel or other suitable metal may be used for these components, as explained in the foregoing.

Therefore, the adjustment of the cup 82 is provided by the machine and screw assembly 84 for the indoor golf hole 80, as compared to the vertical adjustment in indoor golf hole 10 made by the threadable adjustment of the collar 16 on the threading 17 of the canister 14.

In the first and second embodiments, the canisters 14, 42 and collar 16 also may be made of metal such as steel, brass alloy, or cast iron. A durable plastic, such as PVC, is well suited to the invention. The golf cups 15, 43, 62 and 82 are of a standard design and made of a molded durable plastic as is used for typical golf course greens. The cover plates 24, 44, 61 and 81 may be made of a shiny decorative heavy metal, such as brass, but could be formed from almost any other suitable material, including other metals, woods and plastics.

ACHIEVEMENTS OF THE INVENTION

Accordingly, the invention achieves the purpose of providing for an indoor golf hole which may be used to practice putting and otherwise provide an interesting addition to a recreational room, particularly when a flag stick is held by the golf cup. Thus, the indoor golf hole serves a recreational goal, stimulates conversational interest, and adds a certain degree of charm to a room.

The installation may be easily made either through a standard floor and subflooring having supporting joists or may be otherwise installed in a second form of the invention in a poured concrete floor. The adjustment in either form of the invention allows for the golf cup to have its height adjusted to match the walking surface of the room floor and be coplanar therewith for putting. When not in use, a cover plate may be provided, so that the golf hole does not impede walking through the room.

What is claimed is:

1. An indoor golf hole comprising in combination:

a floor construction having an opening therein;

a canister disposed within the opening in the floor construction and having an open upper end for receipt of a golf cup therein;

support means for supporting a golf cup in the canister and adjustment means for adjusting the vertical position of a supported golf cup; and a golf cup adjustably supported within the canister for receiving a putted golf ball.

2. An indoor golf hole as claimed in claim 1 wherein the means for adjustment comprises an adjustable collar threadably engaging said canister.

3. An indoor golf hole as claimed in claim 1 wherein said adjustment means comprises threading on the canister and a threaded collar, the canister being threadably engaged to said collar, said collar being fixably attached to the floor construction.

4. An indoor golf hole as claimed in claim 1 wherein said floor construction comprises subflooring, a flooring layer thereover and floor covering atop the flooring.

5. An indoor golf hole as claimed in claim 4 wherein said indoor golf floor further includes an adjustment collar fixedly mounted to the subflooring and wherein said collar and canister are threadably relatively movable for adjusting the cup.

6. An indoor golf hole as claimed in claim 5 wherein the canister has an open bottom and the support means comprises an annular shoulder of the bottom of the canister for supporting the golf cup thereon.

7. An indoor golf hole as claimed in claim 1 wherein the adjustment means comprises a threaded collar threadably engaging said canister, the canister having threading thereon facilitating said threadable engagement and the collar being cooperative with means for securing the canister to the collar in a locked position.

8. An indoor golf hole as claimed in claim 1 further comprising a cover plate insertably engageable over the golf cup for covering the indoor golf hole.

9. An indoor golf hole as claimed in claim 1 wherein the support means and adjustment means comprise a vertically movable member movable relative to the canister and residing therein, said movable means adjustably supporting said golf cup within the canister.

10. An indoor golf hole as claimed in claim 9 wherein said movable member comprises a disk sized to fit within the canister and having an adjustment screw extending therethrough, said canister further including a double-walled bottom, having one wall above the other, the above wall having a thread engageable aperture for receipt of the adjustment screw whereby to be threadably engageable therewith for changing the relative position of the disk within the canister for adjusting the vertical position of the cup.

11. An indoor golf hole as claimed in claim 10 wherein the floor construction comprises a poured concrete floor.

12. An indoor golf hole as claimed in claim 11 further comprising hydraulic cement surrounding the canister and spacing it from the poured concrete floor to embed the canister in said opening therein.

13. An indoor golf hole as claimed in claim 12 wherein said canister includes an upper portion having a flared strip adjacent the open upper end of the canister, wherein the interior diameter of the canister is constant.

14. An indoor golf hole as claimed in claim 13 wherein said canister includes fasteners extending through said canister and into said hydraulic cement.

15. An indoor golf hole as claimed in claim 1 wherein said canister has a solid bottom wall spaced from a second wall thereabove, said second wall being engaged by said adjustment means, the adjustment means including means for supporting the cup and means for engaging the second wall for relative movement therewith.

16. An indoor golf hole as claimed in claim 1 wherein the support means for supporting a golf cup in the canister and adjustment means for adjusting the vertical position of a supported golf cup comprises a movable disk arranged below the golf cup.

17. An indoor golf hole as claimed in claim 16 wherein the canister has an open bottom end and a cap arranged thereat.

18. An indoor golf hole as claimed in claim 17 wherein the cap includes a central threaded boss and the movable disk having a machine screw extending therethrough for threadable rotational engagement within the threaded boss.

19. An indoor golf hole as claimed in claim 18 wherein the cap includes a side wall extending upwardly on the exterior of the canister.

20. An indoor golf hole as claimed in claim 18 wherein the cap is a flat disk having said threaded boss extending centrally upwardly therefrom.

21. An indoor golf hole as claimed in claim 18 wherein the machines screw is mechanically fastened to the movable disk.

22. An indoor golf hole as claimed in claim 18 wherein said floor construction comprises subflooring and a flooring layer thereover.

23. An indoor golf hole as claimed in claim 22 wherein said indoor golf hole further includes a collar secured around the upper open end of the canister thereof and fixedly mounted to the subflooring.

24. An indoor golf hole as claimed in claim 18 wherein the floor construction comprises a poured concrete floor.

25. An indoor golf hole as claimed in claim 1 wherein the floor construction comprises a poured concrete floor.

26. A golf hole for installation in the flooring structure of a room comprising:

a canister having an open upper end for receipt of a golf cup to be supported therein;

a golf cup supported within said canister;

adjustment means for axially adjusting the relative position of the canister to the golf cup, the adjustment means including means for thread-engagement and for axially movement relative to said canister;

means for attaching the canister to a room flooring structure; and said golf cup having an open upper end for receipt of a putted golf ball therethrough and wherein said adjustment means is capable of adjusting the open upper end of the golf cup relative to the flooring structure.

27. A golf hole as in claim 26 wherein the adjustment means is exterior of the canister.

28. A golf hole as in claim 26 wherein the adjustment means is interior of the canister.

29. A method for installing an indoor golf cup in the flooring of a room comprising the steps of:

forming an opening through a room floor and subfloor;

affixing a collar around said opening and underneath the subfloor;

supporting a canister being engaged by said collar to depend downwardly through said aperture;

disposing a golf cup within said canister;

supporting said golf cup within said canister; and axially adjusting the position of the golf cup relative to the canister to dispose the golf cup at a selected elevation.

30. The method as in claim 29 further comprising fixedly securing said collar to said canister.

31. A method for installing an indoor golf cup in a concrete floor of a room comprising the steps;

coring a hole in a poured concrete floor;

injecting cement within said cored hole;

inserting a canister within said cored hole;

embedding the canister in said cement;

placing a golf cup within said canister;

supporting the golf cup within said canister; and adjusting the relative elevations of the golf cup and the canister to dispose the golf cup in relation to the concrete floor at a selected elevation.

32. The method as in claim 31 further comprising the step of mechanically fastening the canister to the hydraulic cement.

33. The method as in claim 31 further comprising the step of forcing an upper flared strip of the canister into the hydraulic cement to cause radial force against the flared strip from the cement surrounding the canister.

* * * * *